US009598969B2

(12) United States Patent
Wada et al.

(10) Patent No.: US 9,598,969 B2
(45) Date of Patent: Mar. 21, 2017

(54) TURBINE, MANUFACTURING METHOD THEREOF, AND POWER GENERATING SYSTEM

(71) Applicant: KABUSHIKI KAISHA TOSHIBA, Minato-ku (JP)

(72) Inventors: Kunihiko Wada, Yokohama (JP); Satoru Kuboya, Kawasaki (JP); Daizo Saito, Yokohama (JP); Hideyuki Maeda, Yokohama (JP); Nobuhiro Okizono, Yokohama (JP); Iwataro Sato, Hiratsuka (JP); Kazutaka Tsuruta, Yokohama (JP); Naoyuki Okamura, Yokohama (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 844 days.

(21) Appl. No.: 13/921,525

(22) Filed: Jun. 19, 2013

(65) Prior Publication Data

US 2014/0023482 A1 Jan. 23, 2014

(30) Foreign Application Priority Data

Jul. 20, 2012 (JP) ..... 2012-161943
Jul. 20, 2012 (JP) ..... 2012-162096

(51) Int. Cl.
*F01D 11/12* (2006.01)
*F01D 11/00* (2006.01)
*F01D 11/02* (2006.01)

(52) U.S. Cl.
CPC ..... *F01D 11/00* (2013.01); *F01D 11/02* (2013.01); *F01D 11/122* (2013.01); *F05D 2300/21* (2013.01); *Y10T 29/49337* (2015.01)

(58) Field of Classification Search
CPC ..... F01D 11/00; F01D 11/122; F01D 11/02; F01D 11/001; F01D 11/12; F01D 11/125; F01D 5/20; Y10T 29/49337; F05D 2300/21
(Continued)

(56) References Cited

U.S. PATENT DOCUMENTS 3,958,097 A * 5/1976 Fabel ..... B05B 7/226 219/121.36
4,519,840 A * 5/1985 Jackson ..... C22C 29/08 106/1.05
(Continued)

FOREIGN PATENT DOCUMENTS

CN 102135020 A 7/2011
EP 2 270 258 A2 1/2011
(Continued)

OTHER PUBLICATIONS

Combined Chinese Office Action and Search Report issued Nov. 24, 2014 in Patent Application No. 201310304679.9 (with English Translation).

*Primary Examiner* — Ninh H Nguyen
*Assistant Examiner* — Aaron R Eastman
(74) *Attorney, Agent, or Firm* — Oblon, McClelland, Maier & Neustadt, L.L.P.

(57) ABSTRACT

A turbine according to an embodiment includes: a formation object member; a facing member; and a seal part. A formation object member is one of a static part and a rotation part. A facing member is the other of the static part and the rotation part. A seal part at the formation object member is configured to reduce combustion gas leaking between the formation object member and the facing member. The seal part including a ceramics layer. The ceramics layer has a heat conductivity lower than that of the formation object member, and has a concave and convex shape at a surface
(Continued)

thereof. The ceramics layer is not in contact with the facing member, or has hardness higher than that of the facing member so that the facing member is preferentially abraded when the facing member and the ceramics layer are in contact with each other.

12 Claims, 8 Drawing Sheets

(58) Field of Classification Search
USPC ..... 415/173.4
See application file for complete search history.

(56) References Cited

U.S. PATENT DOCUMENTS 4,884,820 A * 12/1989 Jackson ..... C21D 1/09 277/415
5,308,227 A * 5/1994 Gros ..... F01D 5/06 415/173.7
5,952,110 A * 9/1999 Schell ..... F01D 11/12 205/109
6,547,522 B2 * 4/2003 Turnquist ..... F01D 11/122 415/173.3
6,648,596 B1 * 11/2003 Grylls ..... C23C 30/00 164/9
8,002,286 B1 * 8/2011 El-Aini ..... F01D 11/02 277/412
8,167,547 B2 * 5/2012 Wu ..... F01D 11/001 277/418
2006/0171813 A1 8/2006 Malak et al.
2008/0199709 A1 * 8/2008 Ishiwata ..... C23C 14/025 428/457
2009/0017260 A1 * 1/2009 Kulkarni ..... C23C 4/18 428/161
2010/0104426 A1 * 4/2010 Keller ..... F01D 11/12 415/173.1
2010/0158675 A1 * 6/2010 Blanchard ..... F01D 5/225 415/173.4
2011/0014035 A1 1/2011 Kojima et al.
2012/0063881 A1 3/2012 Tallman
2012/0067054 A1 3/2012 Palmer et al.
2014/0331687 A1 11/2014 Palmer et al.

FOREIGN PATENT DOCUMENTS

EP 2 463 406 A2 6/2012
JP 57-97004 A 6/1982
JP 2-19603 A 1/1990
JP 2000-345809 A 12/2000
JP 2011-7153 1/2011
JP 2012-62887 3/2012
WO WO 2012/040214 A1 3/2012

* cited by examiner

TURBINE, MANUFACTURING METHOD THEREOF, AND POWER GENERATING SYSTEM

CROSS REFERENCE TO RELATED APPLICATIONS

This application is based upon and claims the benefit of priority from Japanese Patent Applications Nos. 2012-162096, filed on Jul. 20, 2012 and 2012-161943, filed on Jul. 20, 2012; the entire contents of which are incorporated herein by reference.

FIELD

Embodiments described herein relate generally to a turbine, a manufacturing method thereof, and a power generating system.

BACKGROUND

In a turbine applied for a power generating system, a seal part is provided at a gap between a static part and a rotation part so as to reduce leakage of working fluid from the gap between the static part and the rotation part, and to improve performance. Conventionally, a metal seal made up of a metal material is used as the seal part. Besides, a ceramics seal made up of a ceramics material is used as a seal part for high-temperature. As the ceramics seal, the one having an abradability function which is intentionally abraded between the static part and the rotation part is known from a point of view of making a clearance between the static part and the rotation part small and suppressing damages of the static part or the rotation part. The one which is porous and has a large porosity is known as the ceramics seal having the abradability function.

Besides, a labyrinth seal part formed in a concave and convex state is provided by processing one side or both sides of facing components between an end part of a rotor blade and a shroud segment facing thereto or between a stator blade diaphragm (inner ring) and a turbine rotor facing thereto so as to reduce the leakage of the working fluid between the above-stated facing components and to improve an operation efficiency.

In recent years, needs to make a turbine high-temperature and high-pressure is increasing from a point of view of efficiency of power generation. As a turbine made to be high-temperature and high-pressure, a usage of a $CO_2$ turbine is studied. In the $CO_2$ turbine, combustion gas in which fuel such as natural gas, oxygen, and $CO_2$ are mixed and burned is supplied, and the rotation part is rotated while using supercritical $CO_2$ as a medium to generate electric power. In the $CO_2$ turbine, it is possible to collect $CO_2$ generated by combustion as it is, and therefore, it has been focused from a point of view of global environmental protection because it is possible to effectively use $CO_2$, besides $NO_x$ is not discharged.

However, components are easy to become high-temperature in the $CO_2$ turbine compared to a conventional turbine because the combustion gas becomes high-temperature and high-pressure, and a heat transfer of the combustion gas is large. Accordingly, there is a possibility in which a desired sealing effect cannot be obtained by a conventional metal seal. Namely, there is a possibility in which the combustion gas leaks and it becomes impossible to maintain a differential pressure between an upstream side and a downstream side of the rotation part.

Besides, the ceramics seal, specifically the ceramics seal having the abradability function is also known. It is conventionally applied for a component in which strength is not required, and the facing component forms a blade having a sharp tip by processing a metal material. Accordingly, a coating film having a smooth surface, porous and with the large porosity is used for the conventional ceramics seal. On the other hand, in the $CO_2$ turbine in which the combustion gas becomes high-temperature and high-pressure and the heat transfer of the combustion gas is large compared to the conventional turbine, it is necessary to use ceramics also for facing concave and convex parts, and the conventional ceramics seal which is poor in strength is not necessarily suitable.

Besides, a temperature of fins of the labyrinth seal part becomes high also when the labyrinth seal part is provided, and it becomes a cause of thickness-reduction damage. When a degree of the thickness-reduction damage becomes large, performance of the turbine is lowered because the leakage of the working fluid increases.

DETAILED DESCRIPTION

Hereinafter, embodiments of the present invention will be described with reference to the drawings.

In one embodiment, a turbine includes: a formation object member; a facing member; and a seal part. A formation object member is one of a static part and a rotation part. A facing member is the other of the static part and the rotation part. A seal part at the formation object member is configured to reduce combustion gas leaking between the formation object member and the facing member. The seal part including a ceramics layer. The ceramics layer has a heat conductivity lower than that of the formation object member, and has a concave and convex shape at a surface thereof. The ceramics layer is not in contact with the facing member, or has hardness higher than that of the facing member so that the facing member is preferentially abraded when the facing member and the ceramics layer are in contact with each other.

In another embodiment, a turbine includes: a static part; a rotation part; and a labyrinth seal part. A labyrinth seal part is configured to reduce combustion gas leaking between the static part and the rotation part. The labyrinth seal part includes a member of a ceramic material. The member has first parts provided at the static part, and second parts extending toward the rotation part as fins.

(Turbine According to First Embodiment)

Figure 1:
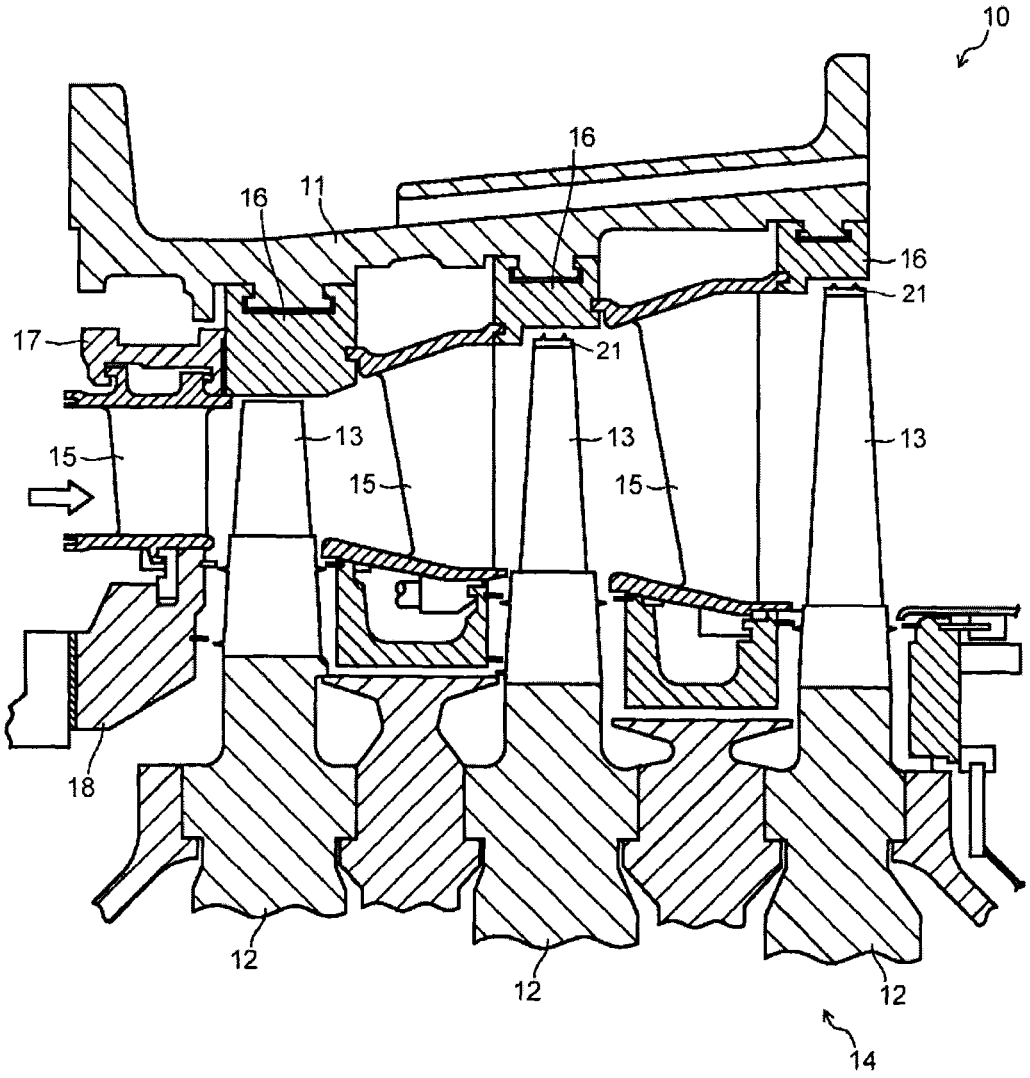
FIG. 1 is a partial sectional view illustrating a turbine according to a first embodiment.

FIG. 1 is a partial meridian cross sectional view illustrating an embodiment of a turbine having a seal part.

A turbine 10 is a $CO_2$ turbine, for example. The $CO_2$ turbine rotates a rotation part by using combustion gas generated by burning of fuel in which $CO_2$ is mixed. The turbine 10 includes a turbine rotor 14 inside a casing 11. The turbine rotor 14 has plural rotor disks 12 in an axial direction. Note that the turbine rotor 14 penetrates plural rotor disks 12. Plural rotor blades 13 are implanted at a periphery of each rotor disk 12. A stator blade (nozzle) 15 is disposed at a frontward of the rotor blade 13, and one turbine stage is made up by the stator blade 15 and the rotor blade 13. Besides, the stator blade 15 is supported by the casing 11 via a shroud segment 16, a retaining ring 17, and a support ring 18. This turbine stage is called as a first stage, a second stage, and a third stage from an upstream side toward a downward side of a flow direction (an arrow direction in FIG. 1) of combustion gas.

Note that the casing 11, the stator blade 15, the shroud segment 16, the retaining ring 17, and the support ring 18 correspond to a static part. Besides, the rotor disk 12, the rotor blade 13, and the turbine rotor 14 correspond to a rotation part.

At the turbine 10, fuel such as natural gas, oxygen, and $CO_2$ are burned under a mixed state in a not-illustrated combustor to generate combustion gas. The combustion gas is introduced into a turbine part including plural turbine stages each made up of the stator blade 15 and the rotor blade 13 via a not-illustrated transition piece. The combustion gas introduced into the turbine part expands at the turbine part to rotate the turbine rotor 14 where the rotor blades 13 are implanted. A power generator and so on are rotary driven by using the rotation of the turbine rotor 14 to generate electric power.

A seal part 21 is provided at the turbine 10 so as to reduce the combustion gas leaking out of a gap of a facing part between the static part and the rotation part. The seal part 21 is provided at least at one member (formation object member) selected from the static part and the rotation part, particularly at a facing part with the other member (facing member). Besides, the seal part 21 has an appropriate clearance for the other member (facing member) facing the formation object member. The seal part 21 is the one not having so-called as an abradability function being worn away by a contact of the member in itself to adjust the clearance to be the minimum. Note that the abradability function may be provided at the facing member so that the facing member is preferentially worn away at the contact time to thereby suppress a damage of the seal part 21. The seal part 21 may be a labyrinth seal part.

For example, the rotor blade 13 making up the rotation part as illustrated in FIG. 1 can be cited as the formation object member where the seal part 21 is provided. In this case, the seal part 21 is provided at an outer end part in a radial direction of the rotor blade 13. Besides, the seal part 21 is provided to have the clearance relative to the facing member, that is, the shroud segment 16. Note that the seal part 21 may be provided at least at a part of the stages, and it is not necessary to be provided at all of the stages.

The formation object member where the seal part 21 is provided may be the member making up the static part. For example, it may be the shroud segment 16 facing the outer end part in the radial direction of the rotor blade 13. In this case, the seal part 21 is formed at an inner surface of the shroud segment 16, namely, at a facing surface with the outer end part in the radial direction of the rotor blade 13. In this case, the seal part 21 has the appropriate clearance relative to the facing member, that is, the rotor blade 13.

The seal part 21 may be provided at either of the rotor blade 13 or the shroud segment 16. It is economical that the seal part 21 is provided at the rotor blade 13 because it is possible to reduce the number of components by providing the seal part 21 at the rotor blade 13, and it is possible to provide simultaneously with a heat-insulating coating for the rotor blade 13. Besides, in case of the rotor blade 13, it is easy to detach from the turbine 10 or the turbine rotor 14, and therefore, repair and regeneration become easy.

(First Configuration Example of Seal Part)

Figure 2:
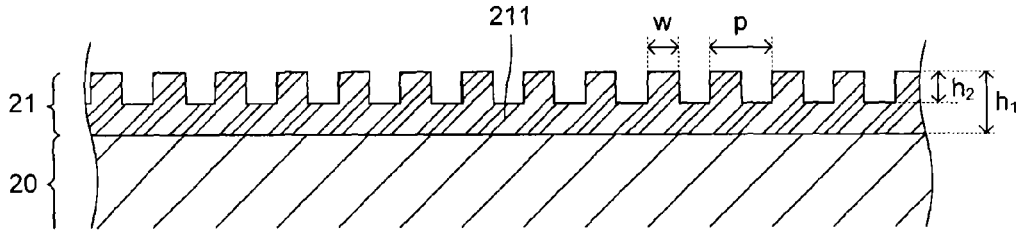
FIG. 2 is a sectional view illustrating a seal part of a first configuration example.

FIG. 2 is a sectional view illustrating a first configuration example of the seal part 21. Note that in FIG. 2, a formation object member 20 where the seal part 21 is provided is collectively illustrated. Here, the rotor blade 13 and the shroud segment 16 can be cited as stated above as the formation object member 20.

The seal part 21 of the first configuration example is provided at least a ceramics layer 211 at a surface of the formation object member 20 where the surface is basically smooth. A heat conductivity of the ceramics layer 211 is lower than a heat conductivity of the formation object member 20, and the ceramics layer 211 has a concave and convex shape at a surface thereof. The surface of the formation object member 20 is basically smooth, and therefore, normally, a rear surface side of the ceramics layer 211 is smooth, and a part of a front surface side is removed to be the concave and convex shape at the seal part 21.

Thus the seal part 21 has the ceramics layer 211 of which heat conductivity is lower than the heat conductivity of the formation object member 20 and having the concave and convex shape at the surface thereof. Therefore, it is possible to maintain reliability even if it is applied for the one of which combustion gas is high-temperature and high-pressure and heat transfer is large such as a $CO_2$ turbine. It is thereby possible to maintain a differential pressure between an upstream side and a downstream side by suppressing leakage of the combustion gas and to improve performance of the $CO_2$ turbine.

In particular, the ceramics layer 211 is provided so as not to get in contact with the facing member owing to have an appropriate clearance, or a surface of the facing member is set to have hardness smaller than hardness of the ceramics layer 211 to make it have the abradability function. Therefore, it is possible to suppress damages of a facing member even if the ceramics layer 211 in itself does not have the abradability function and it is not necessary to make a porosity thereof high as the one having the abradability function. Besides, the concave and convex shape is provided beforehand, and therefore, it is possible to effectively suppress the leakage of the combustion gas, and to improve the performance of the $CO_2$ turbine by maintaining the differential pressure between the upstream side and the downstream side.

In the concave and convex shape, for example, concave parts are provided in a slit state. The concave part is formed at a part of a thickness direction of the ceramics layer 211, for example, as illustrated in FIG. 2. The concave part may be formed so as to penetrate in the thickness direction of the ceramics layer 211 though it is not illustrated. Cross-sectional shapes of the concave part and a convex part are a quadrilateral shape such as a square shape, for example, as illustrated in the drawing. The cross-sectional shape thereof may be a triangle shape, a trapezoid shape, and so on though they are not illustrated. The cross-sectional shape thereof is not necessarily limited.

The heat conductivity at a room temperature of the ceramics layer 211 is preferable to be 5 W/(m/K) or less because a heat conductivity at the room temperature of a general Ni-based superalloy to be the formation object member 20 is 10 W/(m/k) or less. Oxide ceramics is preferable as a composing material of the ceramics layer 211, and for example, zirconium oxide ($ZrO_2$), hafnium oxide ($HfO_2$), cerium oxide ($CeO_2$), dysprosiumoxide ($Dy_2O_3$), gadoliniumoxide ($Gd_2O_3$), yttrium oxide ($Y_2O_3$), pyrochlore type zirconate ($X_2Zr_2O_7$: where X indicates La, Ce, Gd, Eu, Er, Pr, Nd, Dy, or Yb) can be cited. Note that the composing material of the ceramics layer 211 is not necessarily limited to the above-stated composing materials, and it may be silicon nitride, sialon, titaniumnitride, aluminumnitride, and so on.

It is preferable that the porosity of the ceramics layer 211 is 100 or less. Besides, a Rockwell superficial hardness (scale 15-Y) of the ceramics layer 211 is preferable to exceed 80, and more preferable to exceed 100. It is possible to further improve reliability of the seal part 21 and to improve performance of the $CO_2$ turbine by setting the porosity and the hardness as stated above.

It is possible to appropriately change a width w of the convex part, a height $h_1$ of the convex part (corresponding to the thickness of the ceramics layer 211), and a pitch p of the convex part at the ceramics layer 211 in accordance with a configuration of the turbine 10, a position of the seal part 21, the composing material of the ceramics layer 211, and so on.

The width w of the convex part is preferable to be 0.5 mm to 5 mm. When the width w of the convex part is less than 0.5 mm, strength of the convex part becomes insufficient and there is a possibility in which breakage occurs. When it exceeds 5 mm, the number of convex parts capable of being formed at the member becomes insufficient to lower sealing property.

The height $h_1$ of the convex part is preferable to be 0.5 mm to 5 mm. When the height $h_1$ of the convex part is less than 0.5 mm, a fluidic pressure drop becomes small to incur deterioration of the sealing property. When it exceeds 5 mm, the strength of the convex part becomes insufficient and the possibility in which breakage occurs becomes high.

The pitch p of the convex part is preferable to be 2 mm to 10 mm. When the pitch p of the convex part is less than 2 mm, a stagnant part of the combustion gas becomes small, and therefore, the deterioration of the sealing property occurs. When it exceeds 10 mm, the number of the convex parts becomes insufficient to lower the sealing property.

A depth $h_2$ of the concave part is preferable to be $h_1$ to $h_1$−0.5 mm. When the depth $h_2$ of the concave part is larger than $h_1$, there is a possibility in which a substrate metal exposes when the concave part is processed. In this case, the metal is directly exposed to the high-temperature combustion gas, and therefore, there is high possibility in which deterioration occurs at a using time. When it is smaller than $h_1$−0.5 mm, a film thickness becomes too thick, and a possibility in which breakage occurs at the using time resulting from a thermal stress becomes high.

Figure 3:
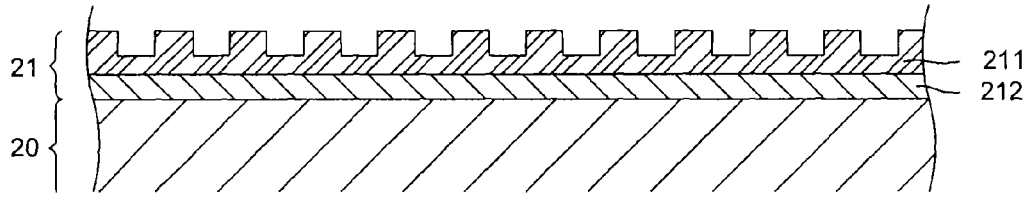
FIG. 3 is a sectional view illustrating a modification example of the seal part of the first configuration example.

FIG. 3 is a sectional view illustrating a modification example of the seal part 21 of the first configuration example. The seal part 21 may be the one in which a metal layer 212 and the ceramics layer 211 are stacked in this sequence on the formation object member 20. The metal layer 212 is provided, and thereby, for example, it is possible to improve a corrosion resistance and an oxidation resistance of the formation object member 20 at high temperature, and formation of the ceramics layer 211 becomes easy. It is preferable to use the one made up of a metal material in which concentration of chromium or aluminum is higher than the formation object member 20 as the metal layer 212, and the one made up of an M-Cr—Al—Y alloy (M indicates at least one kind of element selected from Ni, Co, and Fe) which is particularly excellent in the corrosion resistance and the oxidation resistance at high temperature. When the metal layer 212 is provided, it is preferable that it is 0.01 mm or more, more preferable to be 0.05 mm or more, and generally, it is enough if it is approximately 0.1 mm.

Figure 4:
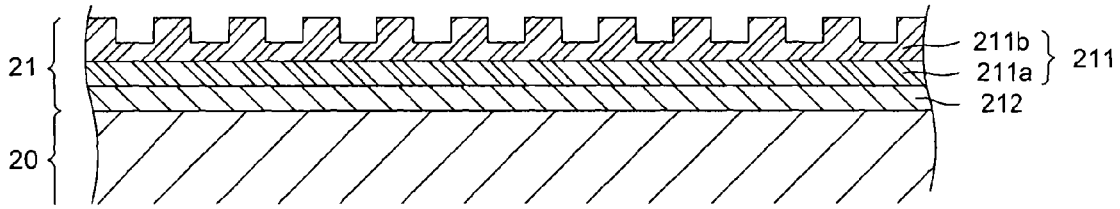
FIG. 4 is a sectional view illustrating another modification example of the seal part of the first configuration example.

FIG. 4 is a sectional view illustrating another modification example of the seal part 21 of the first configuration example. The ceramics 211 may be made up of, for example, plural layers such as a first ceramics layer 211*a* and a second ceramics layer 211*b* from the formation object member 20 side in sequence. In case of the plural layers, a thickness of each layer is preferable to be at least 0.05 mm or more, and more preferable to be 0.1 mm or more.

Note that in case of the plural layers, the concave and convex shape may be formed only at an uppermost layer, and the concave and convex shape may be formed to reach a lower layer thereof. Besides, the above-stated width w of the convex part, the height $h_1$ of the convex part, and the pitch p of the convex part as for the plural layers can be set similar to the case of a single layer.

In case of the plural layers, it is preferable that the porosity of each layer is gradually lowered from a lowermost layer at the formation object member 20 side toward the uppermost layer at a surface side, and the porosity of the uppermost layer is preferable to be 12% or less. The porosity of the uppermost layer is lowered, and thereby, it is possible to improve the reliability of the seal part 21 and to improve the performance of the $CO_2$ turbine 10. Besides, the porosity of the uppermost layer is set to be 8% or less, and thereby, it is possible to further improve the reliability of the seal part 21 and to improve the performance of the turbine 10.

(Second Configuration Example of Seal Part)

Figure 5:
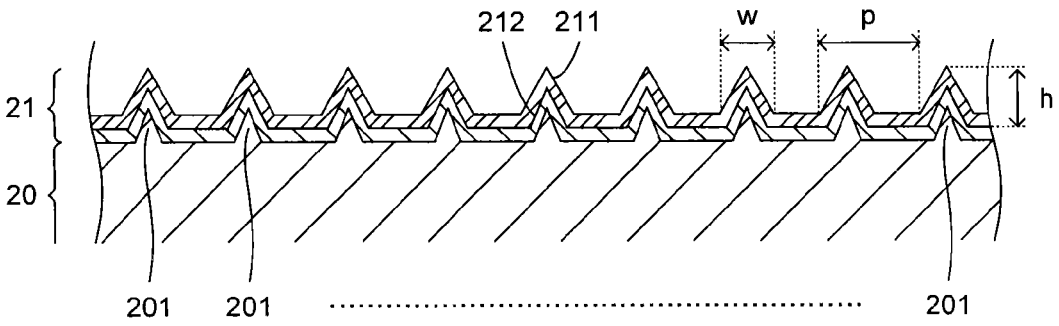
FIG. 5 is a sectional view illustrating a seal part of a second configuration example.

FIG. 5 is a sectional view illustrating a second configuration example of the seal part 21. The formation object member 20 may be the one having convex parts 201 made up of the composing material of the formation object member 20 at the surface thereof. Namely, the seal part 21 may be the one to be the concave and convex shape by using the convex parts 201 at the surface of the formation object member 20.

A triangle shape as illustrated in the drawing can be cited as a representative shape of a cross-sectional shape of the convex part 201, but it may be the quadrilateral shape such as the square shape, the trapezoid shape, or the like. When the convex parts 201 are provided, it is basically possible to provide the ceramics layer 211 as same as the seal part 21 of the first configuration example and to provide the metal layer 212 if necessary.

It is also possible to appropriately change the width w of the convex part, the height h of the convex part, and the pitch p of the convex part of the ceramics layer 211 in accordance with the configuration of the turbine 10, the position of the seal part 21, the composing material of the seal part 21, and so on as for to case of the seal part 21 of the second configuration example, but for example, it is preferable to have ranges described below. Note that when a cross-sectional shape of the convex part of the ceramics layer 211 is the triangle shape and so on, the width w of the convex part is a width at a root part of the convex part, the height h of the convex part is a height from a rear surface part (smooth part) of the ceramics layer 211 to a tip end of the convex part, and the pitch p of the convex part is a length between roots of the adjacent convex parts.

The width w of the convex part is preferable to be 0.5 mm to 5 mm. When the width w of the convex part is less than 0.5 mm, the strength of the convex part becomes insufficient and there is a possibility in which breakage occurs. When it exceeds 5 mm, the number of convex parts capable of being formed at the member becomes insufficient to lower sealing property.

The height h of the convex part is preferable to be 0.5 mm to 5 mm. When the height h of the convex part is less than 0.5 mm, the fluidic pressure drop becomes small to incur deterioration of the sealing property. When it exceeds 5 mm, the strength of the convex part becomes insufficient and the possibility in which breakage occurs becomes high.

The pitch p of the convex part is preferable to be 2 mm to 10 mm. When the pitch p of the convex part is less than 2 mm, the deterioration of the sealing property occurs because the stagnant part of the combustion gas becomes small. When it exceeds 10 mm, the number of the convex parts becomes insufficient to lower the sealing property.

Note that the thickness of the ceramics layer 211 is preferable to be 0.05 mm to 0.2 mm. When the thickness of the ceramics layer 211 is less than 0.05 mm, there is a possibility in which strength of a surface layer becomes insufficient. When it exceeds 0.2 mm, there is a worry in which peeling off may occur caused by the thermal stress generated at the ceramics layer 211.

Figure 6:
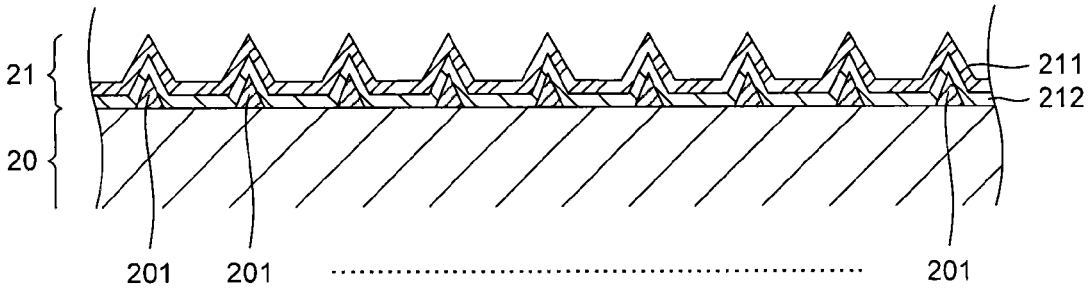
FIG. 6 is a sectional view illustrating a modification example of the seal part of the second configuration example.

FIG. 6 is a sectional view illustrating a modification example of the seal part 21 of the second configuration example.

The convex parts 201 of the formation object member 20 may be made up by a material different from the composing material of the formation object member 20. In this case, it is preferable that the convex part 201 is made up of a high melting point material having a melting point higher than a melting point of the formation object member 20. The convex part 201 projects from the surface of the formation object member 20, and therefore, it is easy to be high temperature affected by the combustion gas compared to a smooth part. The composing material of the convex part 201 is set to be the high melting point material having the melting point higher than the melting point of the formation object member 20, and thereby, it is possible to suppress the deterioration of the reliability of the convex par 201 resulting from the high-temperature.

As the high melting point material making up the convex part 201, for example, it is preferable to use W, Nb, Ta, Mo, or an alloy of these. Note that generally, the corrosion resistance and the oxidation resistance of the high melting point material are not necessarily good, and therefore, it is preferable to provide the metal layer 212 made up of the metal material of which concentration of chromium or aluminum is higher than the formation object member 20, for example, made up of the M-Cr—Al—Y alloy. When the metal layer 212 is provided, it is preferable to be 0.01 mm or more, more preferable to be 0.05 mm, and normally, it is enough if it is approximately 0.1 mm.

(Formation Method of Seal Part)

Hereinafter, a formation method of the seal part 21 is described.

At first, the formation method of the seal part 21 of the first configuration example is described. Note that in the following, the seal part 21 illustrated in FIG. 4 is exemplified to be described.

The metal layer 212 can be formed by depositing particles, clusters, or molecules of a metal layer composing material of the M-Cr—Al—Y alloy and so on in a uniform coating film state by the thermal spraying method, the electron beam evaporation method, and so on, on the surface of the formation object member 20.

The ceramics layer 211 can be formed as described below. At first, particles, clusters, molecules, or the like of a ceramics material to be the first ceramics layer 211*a* are deposited on the metal layer 212 in a uniform coating film state by the thermal spraying method, the electron beam evaporation method, and so on. Further, particles, clusters, molecules, or the like of a ceramics material to be the second ceramics layer 211*b* are deposited in a uniform coating film state by the thermal spraying method, the electron beam evaporation method, and so on. Thereafter, a part of the second ceramics layer 211*b* is removed to make it the concave and convex state.

A publicly known method can be applied for the removal, and for example, it can be performed by a groove grinding method, a pure water jet method, an abrasive water jet method, a laser method, and so on. A method performing the removal by a grindstone and so on can be cited as the groove grinding method. In the pure water jet method, the removal is performed by jet stream. The abrasive water jet method is the one performing the removal by accelerating abrasive particles by jet stream to remove mainly by using these abrasive particles.

A heat conductivity of the ceramics layer 211, namely, the first ceramics layer 211*a* and the second ceramics layer 211*b* can be adjusted by appropriately selecting a kind of the ceramics material used for the thermal spraying method, the electron beam evaporation method, and so on, and by appropriately adjusting the porosity. The porosity can be adjusted by, for example, appropriately selecting a kind of the formation method such as the thermal spraying method, the electron beam evaporation method, and for example, approximately selecting a thermal spraying temperature, a thermal spraying speed, a particle size of a powder used for the thermal spraying, and so on in the thermal spraying method. Besides, a thickness thereof can be set by adjusting a formation time by the thermal spraying method, the electron beam evaporation method, and so on.

Next, a formation method of the seal part 21 of the second configuration example is described.

The formation object member 20 as illustrated in FIG. 5, namely, the one in which the convex parts 201 made up of the composing material of the formation object member 20 are formed can be manufactured such that the parts other than the convex parts 201 are removed by applying the publicly known method such as, for example, the groove grinding method, the pure water jet method, the abrasive water jet method, the laser method for the formation object member 20 of which surface is smooth to leave the convex parts 201. On the other hand, the formation object member 20 as illustrated in FIG. 6, namely, the one in which the convex parts 201 made up of the material different from the composing material of the formation object member 20 are formed can be obtained by forming the convex parts 201 by using a build-up welding method, a laser cladding method, a friction stir surfacing method, a cold spraying method, the thermal spraying method, a plasma powder build-up method, and so on for the formation object member 20 of which surface is smooth.

Besides, the ceramics layer 211, the metal layer 212 can be formed by inputting and depositing the particles, clusters or molecules of the composing materials of each layer such as the ceramics materials, the M-Cr—Al—Y alloy for the formation object member 20 where the convex parts 201 are formed by using the thermal spraying method, the electron beam evaporation method, and so on. Note that when the convex parts 201 are formed at the formation object member 20, it is not easy to uniformly form the ceramics layer 211 and the metal layer 212 on the surfaces of the convex parts 201 because the surface of the convex part 201 inclines and so on. Accordingly, it is preferable to perform the formation as described below in accordance with the formation method.

Figure 7:
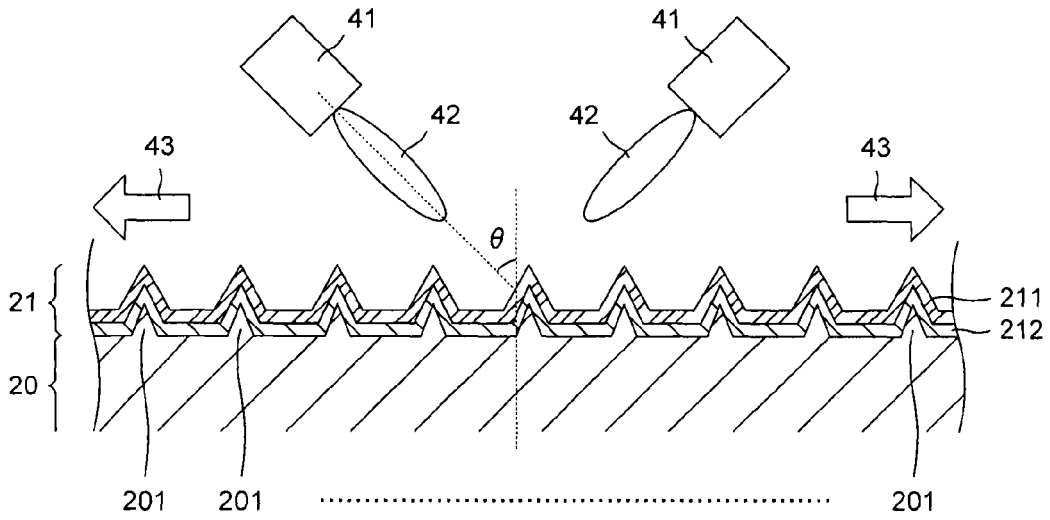
FIG. 7 is a view illustrating an example of a formation method of the seal part by a thermal spraying method.

In case of the thermal spraying method, for example, it is preferable to perform the thermal spraying such that a direction of a thermal spraying flame 42 of a thermal spraying gun 41 becomes a direction inclining for an angle θ relative to a normal direction of the surface of the formation object member 20 for the formation object member 20 where the convex parts 201 are formed as illustrated in FIG. 7. The angle θ is, for example, preferable to be a size in which the direction of the thermal spraying flame 42 is perpendicular to the surface of the convex part 201, but it is not necessarily limited thereto as long as it is possible to uniformly form the ceramics layer 211 and the metal layer 212 at the surfaces of the convex parts 201.

In case of the thermal spraying method, it is preferable to move the formation object member 20 in a right and left moving direction 43 as indicated by arrows in addition to the above. Besides, it is preferable to similarly perform the thermal spraying from an opposite direction according to need. It is thereby possible to uniformly form the ceramics layer 211 and the metal layer 212 to be an appropriate thickness not only on the surface of the formation object member 20 but also on the surfaces of the convex parts 201.

Figure 8:
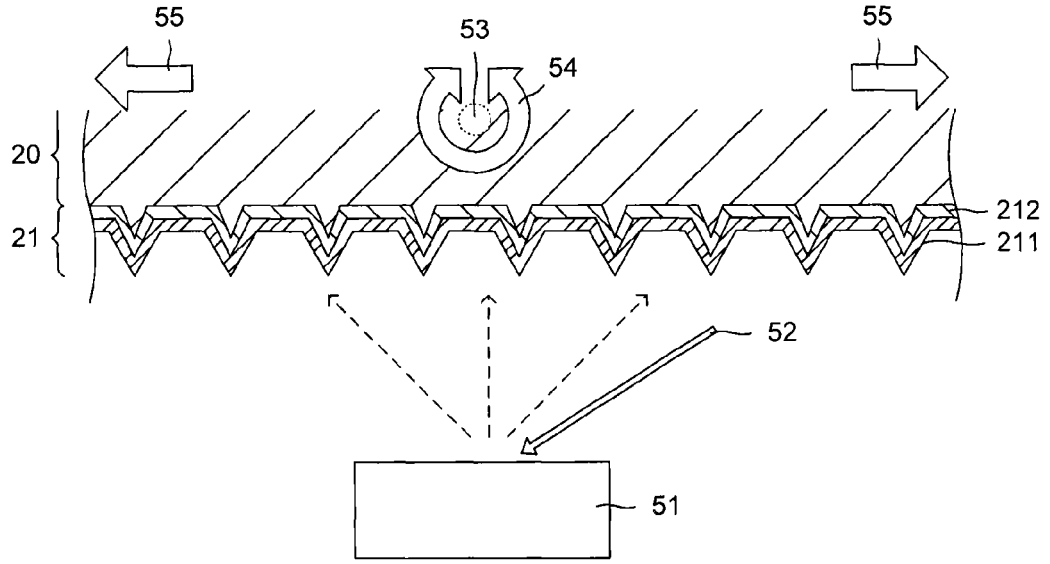
FIG. 8 is a view illustrating an example of the formation method of the seal part by an electron beam evaporation method.

In case of the electron beam evaporation method, for example, an evaporation ingot 51 is disposed to face the formation object member 20 where the convex parts 201 are formed as illustrated in FIG. 8 to perform the evaporation by irradiating electron beam 52 to the evaporation ingot 51. At this time, it is preferable to alternately rotate the formation object member 20 centering on a pivot shaft 53 in a rotation direction 54 of a clockwise rotation and a counterclockwise rotation as indicated by arrows at an angle of a certain degree. Besides, it is preferable to perform while horizontally moving the formation object member 20 in a right and left moving direction 55 as indicated by arrows.

In general, in case of the electron beam evaporation method, an evaporation material is emitted centering on a part of the evaporation ingot 51 where the electron beam 52 is irradiated, and there is a possibility in which it is impossible to uniformly form the ceramics layer 211 and the metal layer 212 to be an appropriate thickness at the surfaces of the convex parts 201. The formation object member 20 is rotated centering on the pivot shaft 53 and the evaporation is performed while horizontally moving in right and left, and thereby, it is possible to uniformly form the ceramics layer 211 and the metal layer 212 to be the appropriate thickness not only at the surface of the formation object member 20 but also at the surfaces of the convex parts 201.

(Power Generating System)

Next, a power generating system where the turbine 10 of the first embodiment is applied is described.

Figure 9:
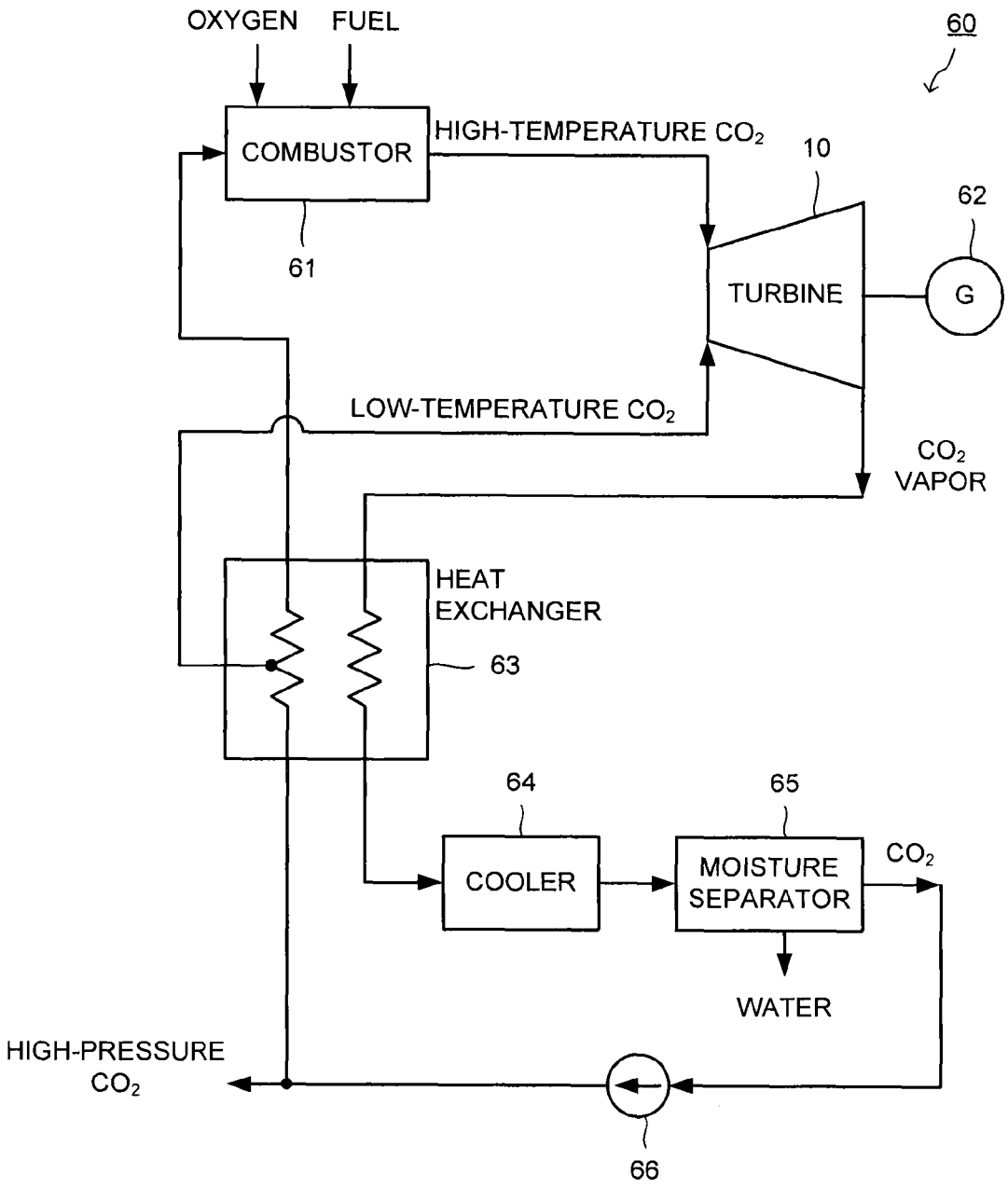
FIG. 9 is a configuration diagram illustrating a power generating system according to an embodiment.

FIG. 9 is a configuration example illustrating a thermal power generating system as an embodiment of the power generating system.

In recent years, it has been studied to enable a thermal power generating system with high environmental harmony in which $CO_2$ is used as a working fluid of a turbine, and power generation and separation/collection of $CO_2$ can be simultaneously performed. For example, a circulation system of oxygen burning using supercritical pressure $CO_2$ is constituted, $CO_2$ is effectively used, and thereby, it becomes possible to enable a zero-emission system which does not discharge $NO_X$.

In the thermal power generating system, for example, fuel of natural gas such as methane and oxygen are introduced into a combustor and burned. The turbine is rotated to perform the power generation while using high-temperature $CO_2$ generated by the burning as the working fluid. Gas ($CO_2$ and vapor) discharged from the turbine is cooled by a heat exchanger, and moisture is separated. Thereafter, $CO_2$ is compressed by a high-pressure pump to obtain high-pressure $CO_2$. A major part of the high-pressure $CO_2$ is heated by the heat exchanger to circulate to the combustor. Remaining high-pressure $CO_2$ is collected to be used for the other usage.

A thermal power generating system 60 illustrated in FIG. 9 is the thermal power generating system with high environmental harmony in which $CO_2$ is used as the working fluid of the turbine 10, and the power generation and the separation/collection of $CO_2$ can be simultaneously performed. In the thermal power generating system 60, the circulation system of oxygen burning using supercritical pressure $CO_2$ is constituted, $CO_2$ is effectively used, and thereby, the zero-emission system which does not discharge $NO_X$ is enabled.

The thermal power generating system 60 illustrated in FIG. 9 includes the turbine 10, a combustor 61, a power generator 62, a heat exchanger 63, a cooler 64, a moisture separator 65, and a high-pressure pump 66 as major components. Note that the combustor 61 may be integrated with the turbine 10.

At the combustor 61, high-pressure $CO_2$ obtained by recycling from discharge gas of the turbine 10 is introduced and methane being the fuel and oxygen are also introduced to be burned, and high-temperature (for example, approximately 1150° C.) $CO_2$ is generated. Oxygen is supplied by, for example, a not-illustrated oxygen generator connected to the combustor 61. The oxygen generator generates oxygen from air to supply to the combustor 61.

At the turbine 10, the high-temperature $CO_2$ generated from the combustor 61 is introduced into an inside of the turbine 10 as the working fluid to do expansion work, the turbine rotor 14 is rotated via the rotor blade 13. On the other hand, low-temperature (for example, approximately 400° C.) $CO_2$ is introduced into the inside of the turbine 10 from a halfway of a flow path in the heat exchanger 63 as a cooling and sealing fluid to perform cooling of the rotor blade 13 and a peripheral part thereof (inner casing and so on). Thus, a sealing process prevents leakage of the working fluid toward outside. Gas ($CO_2$ and vapor) finishes each of the expansion work and the cooling and sealing processes is discharged.

The power generator 62 is disposed coaxially with the turbine 10, and generates electric power in accordance with rotation of the turbine 10. The heat exchanger 63 removes heat from the gas ($CO_2$ and vapor) discharged from the turbine 10 and gives the heat for $CO_2$ reintroduced into the turbine 10 by the heat exchange. In this case, for example, the heat exchanger 63 supplies $CO_2$ at approximately 700° C. to the combustor 61. $CO_2$ at approximately 400° C. obtained from the halfway of the flow path in the heat exchanger 63 is supplied to the turbine 10.

The cooler 64 further cools the gas of which heat is removed by the heat exchanger 63. The moisture separator 65 separates moisture from the gas cooled by the cooler 64, and outputs $CO_2$ of which moisture is removed. The high-pressure pump 66 compresses $CO_2$ of which moisture is removed by the moisture separator 65, outputs high-pressure $CO_2$. A major part of the high-pressure $CO_2$ is supplied to the heat exchanger 63 to be reintroduced into the turbine. On the other hand, the remaining high-pressure $CO_2$ is supplied to the other facilities.

In the constitution as stated above, the high-pressure $CO_2$ obtained by recycling from the discharge gas of the turbine 10 is introduced into the combustor 61, methane being the fuel and oxygen are introduced and burned, then high-temperature $CO_2$ is generated. The high-temperature $CO_2$ generated from the combustor 61 is introduced from upward at an upstream step side of the turbine 10 as the working fluid. On the other hand, the low-temperature $CO_2$ supplied from the halfway of the flow path in the heat exchanger 63 is introduced from downward at the upstream step side of the turbine 10 as the cooling fluid and the sealing fluid. The high-temperature $CO_2$ performs the expansion work in the turbine 10 to rotate the turbine via the rotor blade. On the other hand, the low-temperature $CO_2$ performs the cooling of the rotor blade and the peripheral part thereof (inner casing and so on) and the sealing process. When the turbine rotor 14 of the turbine 10 rotates, the power generator 62 generates electric power.

The gas ($CO_2$ and vapor) finished the expansion work and the cooling and sealing processes is discharged from the turbine 10. The heat of the gas is removed by the heat exchanger 63. After that, the gas is further cooled by the cooler 64, the moisture is separated by the moisture separator 65. Thereafter, $CO_2$ of which moisture is removed is taken out. The $CO_2$ of which moisture is removed by the moisture separator 65 is compressed by the high-pressure pump 66, output as the high-pressure $CO_2$. A major part thereof is supplied to the heat exchanger 63 to be reintroduced into the turbine. On the other hand, the remaining high-pressure $CO_2$ is supplied to the other facilities. The heat exchanger 63 gives heat to the high-pressure $CO_2$ supplied to the heat exchanger 63, then the high-pressure $CO_2$ is supplied to the combustor 61, and the low-pressure $CO_2$ of which temperature is lower than the high-pressure $CO_2$ is supplied to the turbine 10.

It is constituted as stated above, and thereby, it is possible to collect high-purity and high-pressure $CO_2$ without providing an additional equipment (CCS) separating and collecting $CO_2$. Besides, the collected high-pressure $CO_2$ can be stored, in addition, it can be effectively used such that it can be applied for EOR (Enhanced Oil Recovery) used at an oil-drilling field. The EOR is a method to increase a drilling amount of oil by injecting the high-pressure $CO_2$ at a drilling field of an aged oil well. Accordingly, the thermal power generating system 60 is effective from a point of view of global environmental protection.

(Turbine According to Second Embodiment)

Next, an embodiment of a turbine having a labyrinth seal part is described with reference to the drawings.

Figure 10:
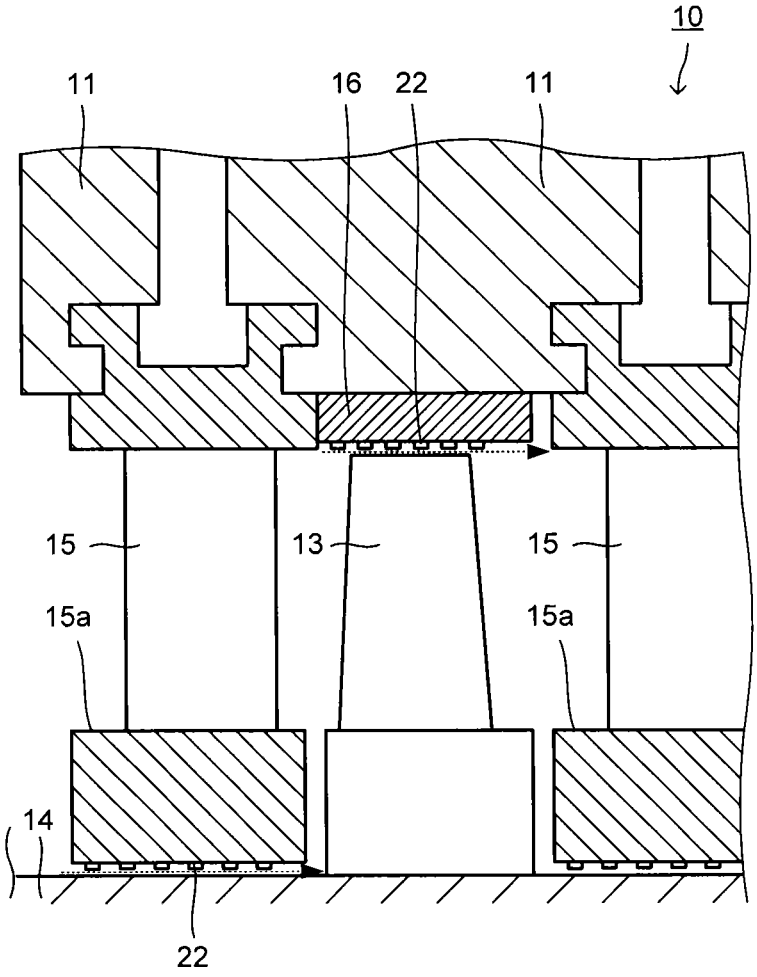
FIG. 10 is a partial schematic sectional view illustrating a turbine according to a second embodiment.

FIG. 10 is a view schematically illustrating an application point of the labyrinth seal part at the turbine 10. Note that an arrow represented by a dotted line in FIG. 10 represents a flow of a working fluid leaks from between a rotation part and a static part.

The turbine 10 having the labyrinth seal part 22 can be applied to the already described thermal power generating system 60. Besides, it is possible to have the constitution basically similar to the already described turbine 10 having the seal part (the turbine according to the first embodiment) except that the labyrinth seal part 22 is held.

Namely, the turbine 10 having the labyrinth seal part 22 is a single discharge type turbine of which working fluid is the high-temperature $CO_2$. The turbine 10 has the turbine rotor (rotation part) 14 of which axle is supported by a bearing (journal, thrust bearing, and so on), a casing (static part) 11 surrounding the turbine rotor 14, and so on as major components.

The turbine rotor 14 includes plural stages of rotor blades 13 along an axial direction. The casing 11 includes plural stages of stator blades 15 disposed in accordance with positions of the plural stages of the rotor blades 13 at the turbine rotor 14 side. A stator blade diaphragm (inner ring) 15*a* is provided at each stator blade 15 to face the turbine rotor 14. An end part facing the turbine rotor 14 at the stator blade diaphragm (inner ring) 15*a* is close to a surface of the turbine rotor 14.

Besides, a shroud segment 16 to protect the casing 11 from the heat of the high-temperature working fluid (high-temperature $CO_2$) and to adjust the clearance of a part where the working fluid passes is provided at an inner side of the casing 11 along the axial direction of the turbine rotor 14. The shroud segment 16 is held by the stator blade 15 by a not-illustrated hook part. A surface facing an end part of the rotor blade 13 at the shroud segment 16 is close to an end part surface of the rotor blade 13. Besides, a fluid for cooling (low-temperature $CO_2$) introduced into the turbine 10 flows in a cooling path inside the stator blade 15 via a cooling path processed in the casing 11. This fluid flows in cooling paths inside the stator blade diaphragm (inner ring) 15*a* and the shroud segment 16 to cool each part.

The labyrinth seal part 22 are formed at, for example, a surface of the stator blade diaphragm (inner ring) 15*a*, specifically, at the surface which is close to the surface of the turbine rotor 14. Besides, the labyrinth seal part 22 are formed at, for example, a surface of the shroud segment 16, specifically at the surface which is close to the end part surface of the rotor blade 13.

(First Configuration Example of Labyrinth Seal Part)

Figure 11:
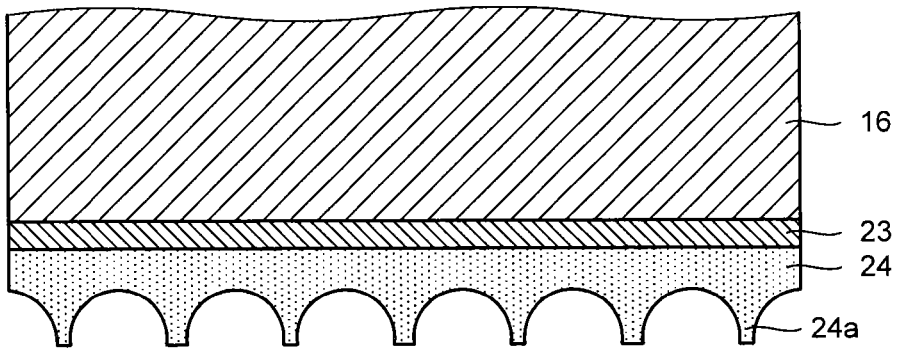
FIG. 11 is a sectional view illustrating a labyrinth seal part of a first configuration example.

FIG. 11 is a view illustrating a first configuration example of the labyrinth seal part 22.

Hereinafter, when apart where the labyrinth fins are formed is the shroud segment 16, specifically, at the part close to the end part surface of the rotor blade 13 at the shroud segment 16 is described. A base material (formation object member) where the labyrinth seal part 22 are formed may be the stator blade diaphragm (inner ring) 15*a*, specifically, a part close to the turbine rotor 14 at the stator blade diaphragm (inner ring) 15*a*.

Note that, the labyrinth fins of the first configuration example are not formed by processing a base material of the shroud segment 16 in itself. The labyrinth fins of the first configuration example are formed by processing a surface of a heat-insulating coating layer (Thermal Barrier Coating: TBC) coated to be formed at the base material via a bond coating layer.

The shroud segment 16 has a base material made up of a heat resistant alloy of which major constituent is at least one kind of element selected from, for example, Ni, Co, and Fe. It is possible to appropriately select and use various kinds of publicly known heat resistant alloys for a composing material of the base material in accordance with usages and so on.

For example, Ni-based superalloy such as IN738, IN939, Mar-M247, RENE80, CMSX-2, CMSX-4, Co-based superalloy such as FSX-414, Mar-M509, and so on can be cited as the heat-resistant alloys effective as the base material.

A bond coating layer 23 is coated to be formed at a surface of the base material, namely at the surface facing the end part surface of the rotor blade 13 being a facing component. It is preferable to form the bond coating layer 23 with the M-Cr—Al—Y alloy (M represents at least one kind of element selected from Ni, Co, and Fe) excellent in corrosion resistance and oxidation resistance, and having an intermediate thermal expansion coefficient between the base material and a later-described heat-insulating coating layer 24.

The bond coating layer 23 made up of the M-Cr—Al—Y alloy guarantees the corrosion resistance and the oxidation resistance, and enables to relieve the thermal stress resulting from a thermal expansion difference between the base material and the heat-insulating coating layer 24.

The bond coating layer 23 can be formed by applying a deposition method such as a plasma thermal spraying method, a high-speed gas flame spraying (HVOF) method, a PVD (physical vapor deposition) method, and a CVD (chemical vapor deposition) method.

The heat-insulating coating layer 24 is coated to be formed on the above-stated bond coating layer 23. The heat-insulating coating layer 24 is made up of, for example, ceramics materials excellent in heat resistance, and of which thermal conductivity is lower than metal materials and so on.

As formation materials of the heat-insulating coating layer 24, ceramics materials such as zirconium oxide, hafnium oxide, aluminum oxide, silicon nitride, sialon, titanium nitride, and aluminum nitride can be used. It is preferable to apply zirconium oxide ($ZrO_2$) and hafnium oxide ($HfO_2$) among them because the heat conductivity is particularly low, the thermal expansion coefficient is large and it is comparatively near to metals. The zirconium oxide and the hafnium oxide containing yttrium oxide, calcium oxide, magnesium oxide, and so on as a stabilizer suppressing a phase change is more preferably used.

In the first configuration example, the surface of the heat-insulating coating layer 24 facing the rotor blade 13 is processed to be in concave and convex state at a predetermined interval along the axial direction of the turbine rotor 14. Labyrinth fins 24*a* extending toward the end part surface of the rotor blade 13 and being close to the end part surface of the rotor blade 13 are thereby formed in plural at a gap part between the shroud segment 16 and the rotor blade 13. The labyrinth fins 24*a* are formed as stated above, and thereby, a shape of the gap part between the base material and the rotation part becomes a resistance of the working fluid, and therefore, the leakage of the working fluid is reduced.

The heat-insulating coating layer 24 where the labyrinth fins 24*a* are formed is excellent in the heat resistance as stated above. Accordingly, it is possible to prevent a thickness-reduction damage of the labyrinth fins caused by the high-temperature of the working fluid passing through this labyrinth fins different from a case when labyrinth fins are formed by processing the base material in itself. It is therefore possible to prevent increase of the leakage of the working fluid from the gap part between the base material and the rotation part resulting that the thickness-reduction damage of the labyrinth fins becomes large and deterioration of performance of the turbine 10.

(Second Configuration Example of Labyrinth Seal Part)

Next, a second configuration example of the labyrinth seal part is described.

In the labyrinth seal part of the second configuration example, the labyrinth fins are formed as described below. At first, grooves are formed in plural at a predetermined interval along the axial direction of the turbine rotor 14 at the base materials of the stator blade diaphragm (inner ring) 15*a*, the shroud segment 16, and so on. Then a ceramic member such as a ceramic plate is inserted into each groove.

Figure 12:
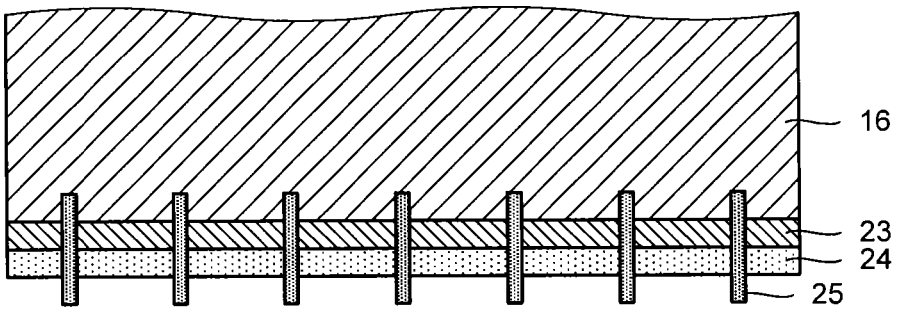
FIG. 12 is a sectional view illustrating a labyrinth seal part of a second configuration example.

FIG. 12 is a sectional view illustrating the second configuration example of the labyrinth seal part. In the second configuration example, a process is performed according to the following procedure to form the labyrinth seal part at a part close to the facing components at the base materials of the static blade diaphragm (inner ring) 15*a*, the shroud segment 16, and so on.

Here, a configuration example forming the labyrinth fins at the part close to the end part surface of the rotor blade 13 at the shroud segment 16 is illustrated. However, a configuration in which the labyrinth fins are formed at the part close to the turbine rotor 14 at the static blade diaphragm (inner ring) 15*a* is the same.

At first, the bond coating layer 23 is coated to be formed as same as the first configuration example at the surface close to the end part surface of the rotor blade 13 being the facing component at the base material of the shroud segment 16. Then the heat-insulating coating layer 24 is coated to be formed on the bond coating layer 23.

The grooves are formed in plural at a predetermined interval along the axial direction of the turbine rotor 14 from the surface of the formed heat-insulating coating layer 24, specifically from the surface facing the end part surface of the rotor blade 13 toward a part at a predetermined depth of the base material via the bond coating layer 23.

A ceramic plate 25 is inserted into each of the formed grooves. One end part of the ceramic plate 25 extend from an entrance part of the groove toward the end part surface of the rotor blade 13 being the facing component of the base material. The one end part of the ceramic plate 25 is close to the end part surface of the rotor blade 13. This ceramic plate 25 has the heat resistance as same as the heat-insulating coating layer 24.

The formation as stated above is performed, and thereby, the labyrinth fins are formed for the base material as same as the labyrinth seal part of the first configuration example, and it is possible to prevent the thickness-reduction damage of the labyrinth fins caused by the high-temperature of the working fluid passing through the labyrinth fins. Accordingly, it is possible to prevent the increase of the leakage of the working fluid and the deterioration of the performance of the turbine resulting that the thickness-reduction damage of the labyrinth fins becomes large.

Besides, in the second configuration example, the labyrinth fins are formed by using the ceramic plates 25, and therefore, it is possible to form the labyrinth fins in a straight line state. It is thereby possible to enhance the resistance for the working fluid and to increase the effect of the prevention of leakage of the working fluid compared to the labyrinth fins of the first configuration example.

(Third Configuration Example of Labyrinth Seal Part)

Next, a third configuration example of the labyrinth seal part is described.

The labyrinth seal part of the third configuration example has a block of a ceramic material where the labyrinth fins are formed at a predetermined interval along the axial direction of the turbine rotor 14. The block of a ceramic material is attached for the base materials of the static blade diaphragm (inner ring) 15*a*, the shroud segment 16, and so on.

Figure 13:
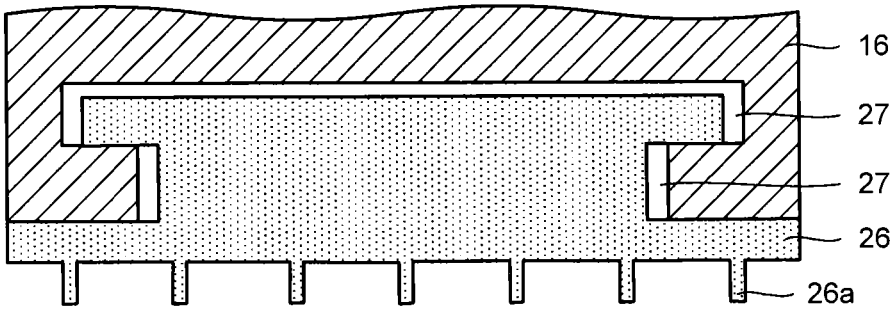
FIG. 13 is a sectional view illustrating a labyrinth seal part of a third configuration example.

FIG. 13 is a sectional view illustrating a configuration example of the labyrinth seal part according to the third configuration example.

Here, a configuration example forming the labyrinth fins at the part close to the end part surface of the rotor blade 13 at the shroud segment 16 is illustrated. A configuration in which the labyrinth fins are formed at the part close to the turbine rotor 14 at the static blade diaphragm (inner ring) 15*a* is the same.

In the third configuration example, a block material 26 made up of a ceramic material where labyrinth fins 26*a* are formed is attached. A groove in T-shape to keep the block material 26 is formed at the base material. The labyrinth fins 26*a* are formed in plural at a surface of the block material 26, specifically, at the surface which is close to the end part surface of the rotor blade 13 being the facing component, at a predetermined interval along the axial direction of the turbine rotor 14 so as to extend toward the end part surface of the rotor blade 13 and to be close to the end part surface of the rotor blade 13.

The block material 26 is processed to be in the T-shape so as to fit the groove formed at the base material, and incorporated in the groove of the base material so that the labyrinth fins 26*a* are close to the surface of the facing component. Besides, the groove of the base material is formed to have a gap 27 when the block material 26 is incorporated. The gap is formed as stated above so as not to have adverse effects on an incorporated state between the block material 26 and the base material when a thermal expansion difference exists between the block material 26 and the base material.

The formation as stated above is performed, and thereby, the labyrinth fins are formed for the base material as same as the first configuration example, and it is possible to prevent the thickness-reduction damage of the labyrinth fins caused by the high-temperature of the working fluid passing through the labyrinth fins. Accordingly, it is possible to prevent the increase of the leakage of the working fluid and the deterioration of the performance of the turbine resulting that the thickness-reduction damage of the labyrinth fin becomes large.

Besides, in the third configuration example, the block material where the labyrinth fins are formed is prepared in addition to the base material, this block is incorporated in the groove of the base material, and thereby, it is possible to provide the labyrinth fins which are close to the surface of the facing component. Accordingly, it is possible to easily form the labyrinth fins which are close to the surface of the facing component at the base material compared to the second configuration example.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A turbine, comprising:

a formation object member being one of a static part and a rotation part;

a facing member being the other of the static part and the rotation part;

a seal part at the formation object member configured to reduce combustion gas leaking between the formation object member and the facing member, the seal part including a ceramics layer; and convex parts between the formation object member and the seal part, the convex parts being made of a high-melting point material of which melting point is higher than that of the formation object member, the ceramics layer having a heat conductivity lower than that of the formation object member, and having a concave and convex shape at a surface thereof, the concave and convex shape forming slits and sealing the turbine together with the facing member, and the ceramics layer being not in contact with the facing member and having a hardness that is the same, higher, or lower than a hardness of the facing member, or the ceramics layer being in contact with the facing member and having a hardness that is higher than that of the facing member so that the facing member is preferentially abraded when the facing member and the ceramics layer are in contact with each other, wherein the seal part includes a metal layer and the ceramics layer on the metal layer, the metal layer including a concentration of chromium or aluminum higher than the formation object member.

2. The turbine according to claim 1, wherein the formation object member is a rotor blade.

3. The turbine according to claim 1, wherein the formation object member is a shroud segment.

4. The turbine according to claim 1, wherein the ceramics layer consist of oxide ceramics.

5. The turbine according to claim 1, wherein the ceramics layer having a porosity of 10% or less.

6. The turbine according to claim 1, wherein the formation object member includes convex parts of a composing material of the formation object member at a surface thereof.

7. The turbine according to claim 1, wherein the turbine is a carbon dioxide turbine.

8. A power generating system, comprising:

a turbine according to claim 1; and a power generator connected to the turbine.

9. A turbine, comprising:

a static part;

a rotation part; and a labyrinth seal part configured to reduce combustion gas leaking between the static part and the rotation part, the labyrinth seal part including:

a bond coating layer coating the static part, a heat-insulating coating layer coating the bond coating layer, and a ceramic member inserted into the static part via the heat-insulating coating layer and the bond coating layer, wherein the ceramic member is configured as a fin.

10. The turbine according to claim 9, further comprising:

a groove provided at the static part, wherein the ceramic member includes a block material incorporated in the groove.

11. The turbine according to claim 9,
wherein the turbine is a carbon dioxide turbine in which the rotation part is rotated by combustion gas including carbon dioxide.

12. A power generating system, comprising:
a turbine according to claim 9; and
a power generator connected to the turbine.

* * * * *